United States Patent [19]

Kimber et al.

[11] 4,037,671

[45] July 26, 1977

[54] DRILL BOOM WITH HYDRAULIC PARALLEL MOTION MEANS

[75] Inventors: Erich Voldemar Kimber, Vendelso; Per-Axel Carsten Ronne, Alta, both of Sweden

[73] Assignee: Atlas Copco Aktiebolag, Nacka, Sweden

[21] Appl. No.: 649,249

[22] Filed: Jan. 15, 1976

Related U.S. Application Data

[63] Continuation of Ser. No. 480,518, June 18, 1974, abandoned.

[30] Foreign Application Priority Data

July 3, 1973 Sweden ..... 7309392

[51] Int. Cl.[2] ..... E21B 15/00; F15B 11/22; F15B 13/01

[52] U.S. Cl. ..... 173/2; 91/170 R; 91/414; 91/420; 91/447; 173/43; 214/763

[58] Field of Search ..... 91/411 B, 412, 413, 91/170 R, 189 R, 414, 447, 420; 173/2, 43; 214/763, 771

[56] References Cited

U.S. PATENT DOCUMENTS

| | | | |
|---|---|---|---|
| 3,462,103 | 8/1969 | Strom | 173/43 |
| 3,476,193 | 11/1969 | Stromnes | 173/43 |
| 3,721,304 | 3/1973 | Hanson | 173/2 |
| 3,922,855 | 12/1975 | Bridwell | 91/414 |

FOREIGN PATENT DOCUMENTS

| | | | |
|---|---|---|---|
| 886,975 | 11/1971 | Canada | 91/411 B |
| 115,050 | 7/1968 | Norway | 173/43 |

*Primary Examiner*—Martin P. Schwadron
*Assistant Examiner*—Abraham Hershkovitz
*Attorney, Agent, or Firm*—Flynn & Frishauf

[57] ABSTRACT

In a drill boom pivotally supporting a rock drilling apparatus, hydraulic parallel motion means is provided which includes a hydraulic pilot cylinder for sensing the setting of the elevation angle of the drill boom. During elevating of the drill boom the hydraulic pilot cylinder is furthermore used as an additional elevating cylinder.

6 Claims, 4 Drawing Figures

DRILL BOOM WITH HYDRAULIC PARALLEL MOTION MEANS

This is a continuation of application Ser. No. 480,518, filed June 18, 1974.

This invention relates to a drill boom arrangement with hydraulic parallel motion means for positioning an elongated rock drilling apparatus at different drilling positions with respect to a boom support.

The type of drill boom to which the invention is directed includes cross shafts respectively being pivoted to the boom support and to the rock drilling apparatus, hydraulic elevating and tilt cylinder means pivotally coupled across the cross shafts respectively for elevating and lowering the rock drilling apparatus and for tilting the same, and the drill boom furthermore being provided with a hydraulic pilot cylinder means connected to said hydraulic tilt cylinder means and pivotally coupled across the cross shaft of the hydraulic elevating cylinder means for hydraulically bound parallel displacement of the rock drilling apparatus during the positioning thereof.

BACKGROUND OF THE INVENTION

In the application of such drill booms the hydraulic pilot cylinder means operates as a pump which consumes a portion of the energy of the hydraulic elevating cylinder means for providing the parallel displacement. Thus the hydraulic elevating cylinder means must be made more heavy than for a pure elevating function. A drill boom of the abovementioned type is disclosed in Canadian Pat. specification No. 886 975. Due to the heavy elevating cylinder means the attachment of the boom becomes relatively voluminous and its design, because of increasing load becomes heavier.

It is an object of the invention to make use of the hydraulic pilot cylinder means as a component for obtaining elevating and lowering of the drill boom under the parallel displacement principle in question with the result that the hydraulic elevating arrangement can be made substantially more compact and can be associated with a lighter boom construction.

SUMMARY OF THE INVENTION

For this and other objects there is according to the invention provided a drill boom arrangement with hydraulic parallel motion means for positioning an elongated rock drilling apparatus to different drilling positions with respect to a boom support, comprising in combination therewith a first cross shaft on said boom support, a drill boom provided at the rear end thereof on said first cross shaft, a second cross shaft at the forward end of said drill boom for pivotally supporting said rock drilling apparatus, hydraulic elevating and tilt cylinder means pivotally connected on the one hand to said drill boom and on the other respectively to said boom support and to said rock drilling apparatus repectively for the elevating and lowering of the rock drilling apparatus and for the tilting thereof, a hydraulic pilot cylinder means pivotally connected to said drill boom and to said boom support for sensing the setting of the elevation angle of said drill boom, a hydraulic circuit including conduit means connecting one chamber of the hydraulic pilot cylinder means with one chamber of the hydraulic tilt cylinder means for purposes of one-sided hydraulic slave coupling thereof whereby to maintain parallel displacement of the rock drilling apparatus during positioning, and means for pressurizing the mutually unbound chambers of the hydraulic pilot cylinder means and the hydraulic tilt cylinder means alternately and simultaneously with the chambers of said hydraulic elevating cylinder means during elevating and lowering of the rock drilling apparatus.

BRIEF DESCRIPTION OF THE DRAWING

The above and other purposes of the invention will become obvious from the following description and from the accompanying drawings in which one embodiment of the invention is illustrated by way of example. It should be understood that this embodiment is only illustrative of the invention and that various modifications thereof may be made within the scope of the claims following hereinafter.

In the drawings.

DETAILED DESCRIPTION OF THE ILLUSTRATED EMBODIMENT

Figure 1:
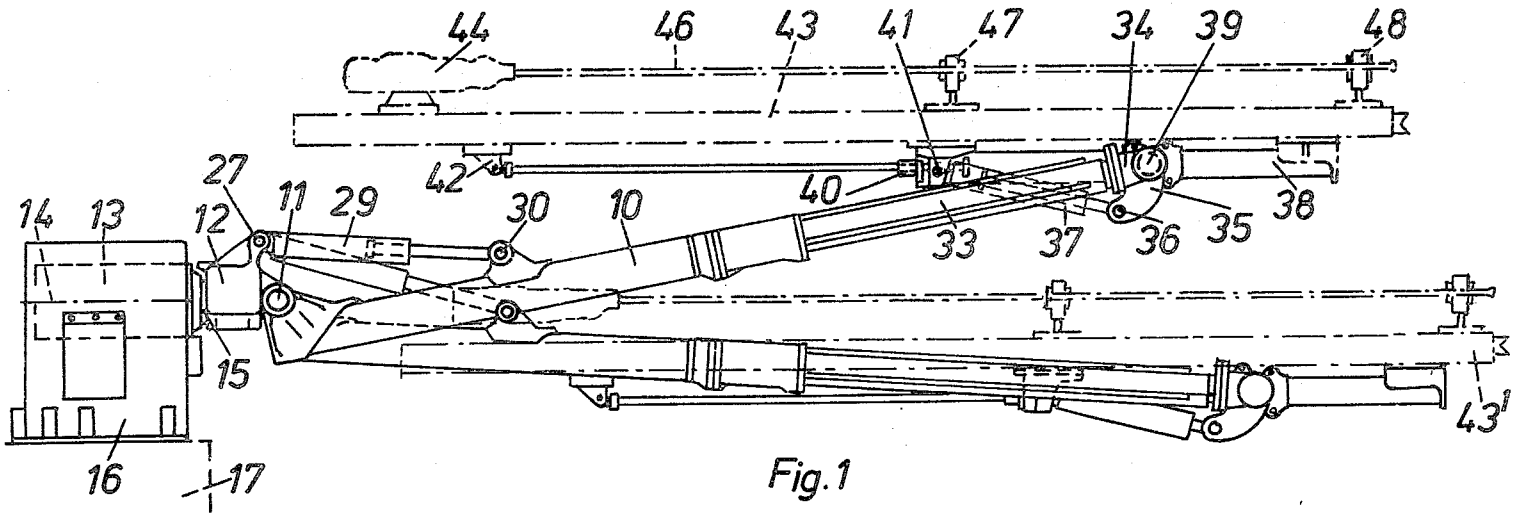
FIG. 1 shows a side view of the drill boom in two alternative positions.
Figure 2:
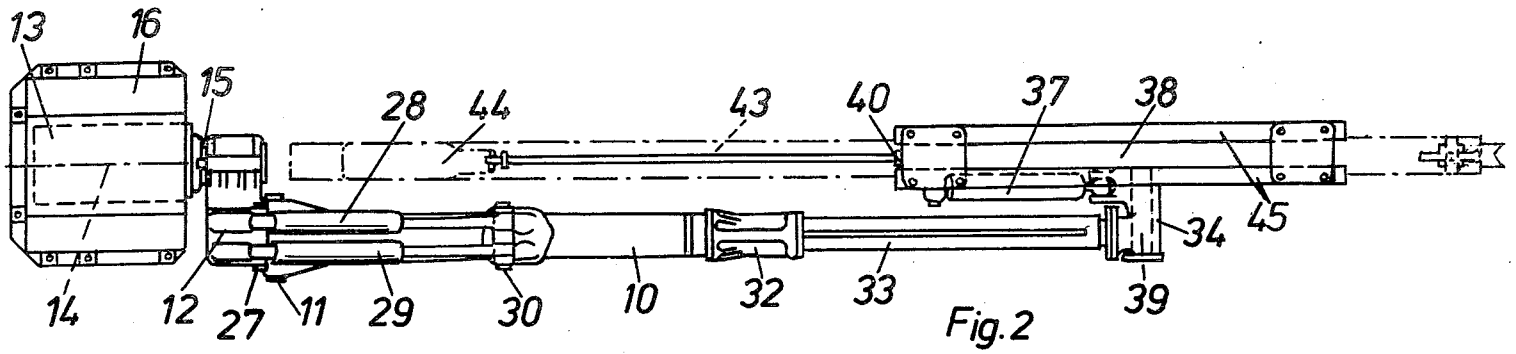
FIG. 2 is a top view of the drill boom in FIG. 1.

In FIGS. 1, 2 a drill boom 10 is pivotally supported on a cross shaft 11 which is carried by a boom support 12. By means of a conventional hydraulic turning means 13 the boom support 12 is turnable 360° around a geometrical polar axis 14 which passes through the center line of a shaft 15 incorportated in the turning means 13. The boom support 12 is non-turnably attached to the shaft 15. The turning means 13 is mounted in a housing 16 which is supported by an element 17. The latter forms part of a drill wagon or rig, not shown, on which several drill booms 10 can be mounted in a group.

Laterally of the shaft 15 the boom support 12 carries a cross shaft 11, about which the drill boom 10 is pivotally journalled. The boom support 12 further carries a shaft 27 parallel with the cross shaft 11. The shaft 27 forms a pivotal connection on the one hand for a hydraulic elevating cylinder 28 and on the other for a hydraulic pilot cylinder 29, which both with the ends of their piston rods are pivotally attached to a shaft 30 on the drill boom 10.

The drill boom 10 supports at its outer end a journal bearing 32 in which a boom extension member 33 is carried axially slidably but nonrotatably. The boom extension member 33 is adjustagle longitudinally relative to the drill boom 10 by means of a hydraulic cylinder mounted within the drill boom in conventional manner. The boom extension member 33 further supports a boom head 34 provided with journalling lugs 35 at which a hydraulic tilt cylinder 37 is pivotally connected to a shaft 36. The tilt cylinder 37 is pivotally attached to a shaft 41 on a feed holder 38 which by means of a cross shaft 39 parallel with the cross shaft 11 is turnably journalled on the boom head 34. The feed holder 38 is included in a rock drilling apparatus which furthermore includes a feed bar 43 supporting in conventional manner a rock drilling machine 44 fed to and fro therealong by motor power.

A hydraulic feed bar displacing cylinder 40 is fixed to the feed holder 38 and to a bracket 42 on the feed bar 43. The rock drilling machine 44 rotates and delivers impacts against a drill steel 46 which is guided by means of drill steel centralizers 47, 48 arranged on the feed bar. The feed bar 43 is supported slidably in longitudinal direction on the feed holder 38 by means of guides 45 arranged thereon. By extension or contraction of the hydraulic feed bar displacing cylinder means 40 the feed bar can be adjusted longitudinally relative to the drill boom 10.

By actuation of the hydraulic cylinders 28, 29 and the hydraulic tilt cylinder 37 the drill boom 10 and the rock drilling apparatus are adjusted angularly whereby the latter moves in a pivotal plane extending through the polar axis 14. By actuation of the turning means 13 this plane can be turned around the polar axis 14. As is evident from FIG. 2 the rock drilling apparatus has a free motion clearance with respect to the drill boom 10 during its swinging by means of the hydraulic cylinders 28, 29 and 37 and the rock drilling machine 44 can unimpededly be lowered to alignment with or under the polar axis 14, FIG. 1. Since the pivotal plane of the rock drilling apparatus can be turned 360° by means of the turning means 13 all dead zones in connection with hole drilling in the forward direction are thereby eliminated. For all hydraulic cylinders of the drill boom 10 a conventionally coupled hydraulic operating system is constructed. This coupling circuitry includes a coupling circuitry for parallel displacement of the rock drilling apparatus during positioning of the drill boom, which is illustrated diagramatically in FIGS. 3 and 4.

Figure 3:
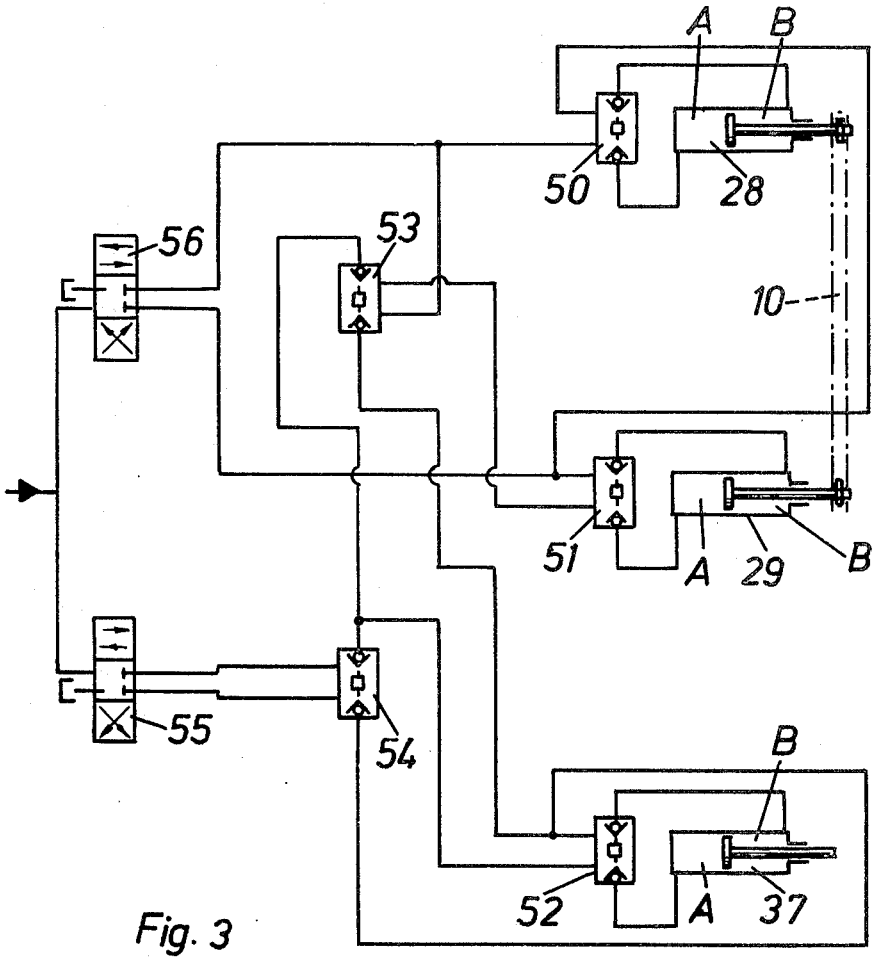
FIG. 3 is a hydraulic circuitry for parallel displacement and operating of the drill boom in FIG. 1.
Figure 4:
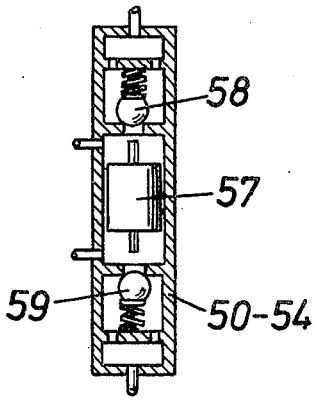
FIG. 4 shows the fundamental construction of the hydraulic locks included in the hydraulic circuitry in FIG. 3.

As evident from the circuitry in FIG. 3 each of the hydraulic cylinders 28, 29 and 37 is provided with a hydraulic lock respectively 50, 51 and 52 of conventional type, suitably provided with a reversing piston 57, which cooperates with a couple of check valves 58, 59 as is evident from FIG. 4. Further, two interjoined hydraulic locks 53, 54 of the same design are included. The hydraulic pilot cylinder 29 and the hydraulic elevating cylinder 28 are mechanically coupled together over the diagrammatically represented drill boom 10 for bound common movement. The larger cylinder chamber A of the hydraulic pilot cylinder 29 is over the hydraulic lock 51 and the interjoined hydraulic lock 53 connected to the larger cylinder chamber A of the tilt cylinder 37 via the hydraulic lock 52 of the latter. The other interjoined hydraulic lock 54 is inserted between an individual control valve means 55 associated with the tilt cylinder 37 and the hydraulic lock 52. Through the connection between chambers A in the hydraulic cylinders 29, 37, the hydraulic pilot cylinder 29 becomes one-sidedly hydraulically bound to the hydraulic tilt cylinder 37. A common control valve 56 is in control of the hydraulic elevating cylinder 28 via its hydraulic lock 50 and as well in control of the smaller cylinder chambers B in the hydraulic pilot cylinder 29 via its hydraulic lock 51 and in the hydraulic tilt cylinder 37 via its hydraulic 52 and the interjoined hydraulic lock 53.

Supppose that the common control valve 56 in FIG. 3 is moved downwards from the neutral position. At this position, as is evident from the conduit drawing, on the one hand the cylinder chamber B in the hydraulic elavating cylinder 28 via the chack valve 58 of the hydraulic lock 50 and the corresponding chamber B in the hydraulic pilot cylilnder 29 via the check valve 58 of the hydraulic lock 51 are pressurized. The opposite check valves 59 of the hydraulic locks 50 and 51 opened by the reversing piston 57 make possible on the one hand that the chamber A in the elevating cylinder 28 is connected to low pressure via the control valve 56, on the other that chamber A in the hydraulic pilot cylinder 29 via the check valve 58 of the interjoined hydraulic lock 53 and the check valve 59 of the hydraulic lock 52 is connected to chamber A in the tilt cylinder 37. Because of this a one-sided connection arises between the hydraulic pilot cylinder 29 and the hydraulic tilt cylinder which is utilized to parallel-displace the rock drilling apparatus for instance to the position shown in FIG. 1 from the initial position 43[1] by means of the tilt cylinder 37 when the hydraulic elevating cylinder 28 and the hydraulic pilot cylinder 29 are contracted. The hydraulic pilot cylinder 29 at the same time operates as an additional elevating eylinder amplifying the elevation. During the one-sidedly bound movement, the chamber B in the tilt cylinder 37 is contracted since it is open to low pressure via the check valve 58 of the hydraulic lock 52, the check valve 59 of the interjoined hydraulic lock 53 and the common control valve 56.

When the common control valve 56 is moved upwards in FIG. 3 the chamber A in the elevating cylinder 28 is pressurized via the check valve 59 of the hydraulic lock 50, which cylinder consequently is extended. At the same time the chamber B in the tilt cylinder 37 is pressurized via the check valve 59 of the interjoined hydraulic lock 53 and the check valve 58 of the hydraulic lock 52, which cylinder consequently is contracted and presses the content in its chamber A to the chamber A in the pilot cylinder 29 connected therewith via the check valve 59 of the hydraulic lock 52, the check valve 58 of the interjoined hydraulic lock 53 and the check valve 59 of the hydraulic lock 51. Because of this the pilot cylinder 29 as well as the elevating cylinder 28 is forced to extend, whereby the tilt cylinder thus is used for amplifying the lowering movement of the boom. This is especially important when the drill boom in FIG. 1 has been turned 180° around the polar axis 14 whereat an extension of the elevating cylinder 28 and the pilot cylinder 29 will mean an elevating movement under a full load of the drill boom 10.

By making the hydraulic pilot, elevating and tilt cylinders all three of equal size and by giving them the same mounting geometry an exact parallel displacement of the rock drilling apparatus during the swingings of the drill boom 10 is safeguarded.

From the hydraulic circuitry in FIG. 3 it is evident that by actuation of the control valve 55 the tilt cylinder 37 can be actuated independently of other cylinders until the desired initial angle for the rock drilling apparatus is obtained by virtue of the blocking action of the parallel interjoined hydraulic lock 53.

What we claim is:

1. A drill boom arrangement with hydraulic parallel motion means for positioning an elongated rock drilling apparatus to different drilling positions with respect to a boom support, somprising in combination therewith:

a first cross shaft on said boom support, a drill boom having forward and rear ends, said drill boom being pivoted at the rear end thereof on said first cross shaft, a second cross shaft at the forward end of said drill boom for pivotally supporting said rock drilling apparatus, an hydraulic elevating cylinder means pivotally connected at one end thereof to said drill boom and at the other end thereof to said boom support for selectively elevating and lowering the rock drilling apparatus to given elevation angles, an hydraulic tilt cylinder means pivotally connected at one end thereof to said drill boom and at the other end thereof to said rock drilling apparatus for selectively tilting said rock drilling apparatus relative to said drill boom independently of said hydraulic elevating cylinder means, said hydraulic tilt cylinder means having a pair of hydraulic chambers, an hydraulic pilot cylinder means having a pair of chambers and pivotally connected to said drill boom and to said boom support for sensing the elevation angle of said drill boom, and an hydraulic circuit including fluid conduit means connecting one chamber of said hydraulic pilot cylinder means with one chamber of said hydraulic tilt cylinder means to selectively transfer hydraulic fluid therebetween to provide hydraulic slave coupling between said hydraulic pilot cylinder means and tilt cylinder means to concurrently operate same in order to tilt said rock drilling apparatus while maintaining parallel displacement of the rock drilling apparatus during operation of said hydraulic elevating cylinder means to change the drilling position; a common hydraulic control valve coupled to said hydraulic pilot, tilt and elevating cylinder means for alternately pressurizing the other chambers of said hydraulic pilot cylinder means and said hydraulic tilt cylinder means simultaneously with the chambers of said hydraulic elevating cylinder means during elevating and lowering of the rock drilling apparatus, respectively; a second control valve coupled to said hydraulic tilt cylinder means for actuation thereof independently of said hydraulic elevating and pilot cylinder means; first isolating valve means for isolating said hydraulic elevating and pilot cylinder means from said second control valve during actuation of said second control valve; and second isolating valve means for isolating said second control valve from said hydraulic tilt cylinder means during actuation of said common control valve, whereby said hydraulic pilot cylinder means assists the elevating movement of said drill boom and said hydraulic tilt cylinder means assists the lowering movement of said drill boom.

2. A drill boom arrangement according to claim 1 in which said hydraulic pilot and elevating cylinder means are a duality of adjacent cylinders.

3. A drill boom arrangement according to claim 1 in which said hydraulic pilot, elevating and tilt cylinder means are of equal size.

4. A drill boom arrangement according to claim 3 in which said hydraulic pilot and elevating cylinder means have a coincident pivot axis, and said hydraulic pilot, elevating and tilt cylinder means are mounted such that a first triangle formed by lines interconnecting the pivot points of said pilot and elevating cylinder means and said first cross-shaft is geometrically "similar" to a second triangle formed by lines interconnecting the pivot points of said tilt cylinder means and said second cross-shaft.

5. A drill boom arrangement according to claim 1 in which said hydraulic elevating and pilot cylinder means are of equal size, and including common cross-shafts on said drill boom and said boom support for said pivotal mounting of said hydraulic elevating and pilot cylinder means thereto, respectively.

6. A drill boom arrangement according to claim 1 wherein said hydraulic circuit includes means for transferring hydraulic fluid from one chamber of one of said hydraulic pilot cylinder means and said hydraulic tilt cylinder means to one chamber of the other of said hydraulic pilot cylinder means and hydraulic tilt cylinder means responsive to an increase in pressure in the first mentioned one of said chambers.

* * * * *